US005469871A

United States Patent [19]

Barnes et al.

[11] Patent Number: 5,469,871

[45] Date of Patent: Nov. 28, 1995

[54] CIGARETTE AND METHOD OF MAKING SAME

[75] Inventors: Vernon B. Barnes; Donald R. Wilkinson, both of Clemmons; Lloyd H. Hancock, Walnut Cove, all of N.C.; Erwin Oesterling, Glinde, Germany; Siegfried Schlisio, Geesthacht, Germany; Werner Hinz, Lauenburg, Germany

[73] Assignee: R. J. Reynolds Tobacco Company, Winston-Salem, N.C.

[21] Appl. No.: 89,502

[22] Filed: Jul. 16, 1993

Related U.S. Application Data

[63] Continuation-in-part of Ser. No. 947,021, Sep. 17, 1992, abandoned.

[51] Int. Cl.[6] ..... A24C 5/00

[52] U.S. Cl. ..... 131/194; 131/94; 131/359

[58] Field of Search ..... 131/194, 359, 131/94

[56] References Cited

U.S. PATENT DOCUMENTS

| | | | |
|---|---|---|---|
| 5,020,548 | 6/1991 | Farrier et al. | 131/194 |
| 5,119,834 | 6/1992 | Shannon et al. | 131/194 |
| 5,129,409 | 7/1992 | White et al. | 131/364 |
| 5,247,947 | 9/1993 | Clearman et al. | 131/194 |

*Primary Examiner*—Jennifer Bahr
*Attorney, Agent, or Firm*—Grover M. Myers; David G. Conlin

[57] ABSTRACT

Cigarettes and methods of making them, in which an insulated fuel element is combined with a substrate assembly comprising a substrate within a tube, combining a roll of tobacco with a plug of tobacco paper, combining the fuel element/substrate assembly with the tobacco/tobacco paper assembly, and combining the resulting combination with a filter element to produce filter cigarettes. Methods of constructing the various and preferred subassemblies are also disclosed.

24 Claims, 7 Drawing Sheets

CIGARETTE AND METHOD OF MAKING SAME

This is a continuation-in-part of application Ser. No. 07/947,021, filed Sep. 17, 1992 now abandoned.

FIELD OF THE INVENTION

The present invention is directed to cigarettes and a method of manufacturing the same. Many improved cigarettes have been proposed. For example, numerous references have proposed cigarettes which generate a flavored vapor and/or a visible aerosol. Many of such cigarettes have employed a combustible fuel source to provide an aerosol and/or to heat an aerosol forming material. See, for example, the background art cited in U.S. Pat. No. 4,714,082 to Banerjee et al.

BACKGROUND OF THE INVENTION

The present invention relates to cigarettes, and in particular to those cigarettes having a short fuel element and a physically separate aerosol generating means. Cigarettes of this type, as well as materials, methods and/or apparatus useful therein and/or for preparing them, are described in the following U.S. Pat. Nos. 4,714,082 to Banerjee et al., 4,732,168 to Resce; 4,756,318 to Clearman et al., 4,782,644 to Haarer et al., 4,793,365 to Sensabaugh et al., 4,802,568 to Haarer et al., 4,807,809 to Pryor et al., 4,827,950 to Banerjee et al., 4,858,630 to Banerjee et al., 4,870,748 to Hensgen et al., 4,881,556 to Clearman et al., 4,893,637 to Hancock et al.; 4,893,639 to White; 4,903,714 to Barnes et al.; 4,917,128 to Clearman et al.; 4,928,714 to Shannon; 4,938,238 to Barnes et al.; 4,989,619 to Clearman et al.; 5,027,836 to Shannon et al.; 5,027,839 to Clearman et al.; 5,042,509 to Banerjee et al.; 5,052,413 to Baker et al.; 5,060,666 to Clearman et al.; 5,065,776 to Lawson et al.; 5,067,499 to Banerjee et al.; 5,076,292 to Baker et al.; 5,099,861 to Clearman et al.; 5,101,839 to Jakob et al.; 5,105,831 to Banerjee et al.; 5,105,837 to Barnes et al., and 5,119,837 to Banerjee et al., 5,183,062 to Clearman et al., and 5,203,355 to Clearman, et al., as well as in the monograph entitled Chemical and Biological Studies of New Cigarette Prototypes That Heat Instead of Burn Tobacco, R. J. Reynolds Tobacco Company, 1988 (hereinafter "RJR Monograph"). These cigarettes are capable of providing the smoker with the pleasures of smoking (e.g., smoking taste, feel, satisfaction, and the like). Such cigarettes typically provide low yields of visible sidestream smoke as well as low yields of FTC tar when smoked.

The cigarettes described in the aforesaid patents and/or publications generally employ a combustible fuel element for heat generation and an aerosol generating means, positioned physically separate from, and typically in a heat exchange relationship with the fuel element. Many of these aerosol generating means employ a substrate or carrier for one or more aerosol forming materials, e.g., polyhydric alcohols, such as glycerin. The aerosol forming materials are volatilized by the heat from the burning fuel element and upon cooling form an aerosol. Normally, the fuel elements of such smoking articles are circumscribed by an insulating jacket.

SUMMARY OF THE INVENTION

The present invention is directed to improvements in cigarettes having a short carbonaceous fuel element and a physically separate aerosol generating means as well as improved methods of manufacturing such cigarettes.

Preferred cigarettes of the present invention include a short extruded carbonaceous fuel element which is circumscribed by an insulating jacket. Normally, the fuel element has one or more longitudinal grooves extending along its outer periphery. Such grooves assist in lighting of the fuel element and allow heated air to flow along the periphery of the fuel element. The grooves also tend to assist in retaining the fuel element within the jacket.

The length of the fuel element is typically from 3 mm to about 20 mm, preferably about 5 mm to about 16 mm and most preferably about 6 mm to about 12 mm in length prior to burning.

The fuel element is retained within the cigarette of the present invention by an insulating jacket. Preferably the insulating jacket circumscribes the entire longitudinal periphery of the fuel element, although it may extend beyond each end of the fuel element, effectively recessing the fuel element, separating it from the other components of the cigarette. The preferred resilient nature of the insulating jacket allows it to extend into any grooves on the periphery of the fuel element. The insulating jacket also aids in retaining heat and permits radial atmospheric air to flow to the fuel element during use.

In one especially preferred embodiment, the resilient insulating means comprises a fibrous material which circumscribes the longitudinal periphery of the fuel element. The fibrous material may comprise glass fibers (Owens-Corning "C" glass is especially preferred), a tobacco filler/glass fiber mixture, gathered or shredded tobacco paper, gathered or shredded carbon paper, tobacco cut filler, or the like.

Typically a carbonaceous mass is extruded into a continuous rod of a desired shape, laid directly onto a ribbon of insulating material which is circumscribed by a wrapper to form a jacketed continuous rod. The jacketed continuous rod is cut into appropriate length useful in the manufacturing method of the present invention. During manufacturing, as aqueous liquid such as tap water is applied in an appropriate amount to the carbonaceous rod and/or insulating material which assists in bonding the carbonaceous rod to the insulating material upon drying to an appropriate moisture.

The cigarette further includes an aerosol generating means which includes a substrate and at least one aerosol forming material. A preferred aerosol generating means includes an aerosol forming material (e.g., glycerin), tobacco in some form (e.g., tobacco powders, tobacco extract or tobacco dust) and other aerosol forming materials and/or tobacco flavoring agents, such as cocoa, licorice and sugar. The aerosol forming material generally is carried in a substrate material, such as a reconstituted tobacco cut filler or by a substrate such as tobacco cut filler, gathered paper, gathered tobacco paper, or the like.

Preferably the substrate is a reconstituted tobacco cut filler cast sheet material, which is formed into a continuous rod or substrate tube assembly on a conventional cigarette making machine. Typically the overwrap material for the rod is a barrier material such as a paper foil laminate. The foil serves as a barrier, and is located on the inside of the overwrap.

Alternatively, the substrate may be a gathered paper formed into a rod or plug. When the substrate is a paper-type material, it is highly preferred that such substrate be positioned in a spaced apart relationship from the fuel element. A spaced apart relationship is desired to minimize contact between the fuel element and the substrate, thereby preventing migration of the aerosol forming materials to the fuel, as well as limiting the scorching or burning of the paper substrate. The spacing is normally provided during manufacture of the cigarette in accordance with one method of making the present invention. Appropriately spaced substrate plugs are overwrapped with a barrier material to form a substrate tube assembly having spaced substrate plugs therein. The substrate tube assembly is cut between the substrate plugs to form substrate sections. The substrate sections include a tube with a substrate plug and void(s), preferably at each end.

The barrier material for making the tube aids in preventing migration of the aerosol former to other components of the cigarette. The barrier material forming the tube is a relatively stiff material so that when formed into a tube it will maintain its shape and will not collapse during manufacture and use of the cigarette.

An appropriate length of the jacketed fuel element is combined with a substrate section or substrate tube assembly by a wrapper material, which has a propensity not to burn, to form a fuel/substrate section. In preferred embodiments of the cigarettes, the wrapper typically extends from the mouthend of the substrate section, over a portion of the jacketed fuel element, whereby it is spaced from the lighting end of the fuel element. The wrapper material assist in limiting the amount of oxygen which will reach the burning portion of the fuel element during use, preferably thereby causing the fuel element to extinguish after an appropriate number of puffs. In especially preferred embodiments of the cigarette, the wrapper is a paper/foil/paper laminate. The foil provides a path to assist in dissipating or transferring the heat generated by the fuel element during use. The jacketed fuel element and the substrate section are joined by the overwrap.

A tobacco section is preferably formed by a reconstituted tobacco cut filler rod, made on a typical cigarette making machine, and cut into appropriate lengths. A filter rod is formed and cut into appropriate lengths for joining to the tobacco section to form a mouthend section. The fuel/substrate section and the mouthend section are joined by aligning the reconstituted ends of each section, and overwrapped to form a cigarette.

When a paper substrate is used, a tobacco paper rod and a reconstituted cut filler rod are preferably formed and cut into appropriate lengths and joined to form a tobacco section.

The tobacco section and the fuel/substrate section are joined by aligning the tobacco paper plug end of the tobacco section with the substrate end of the fuel/substrate section and joining the sections with a wrapper which extends from the rear end of the tobacco roll to an appropriate length past the junction of the two sections for forming the tobacco roll/fuel assembly. The tobacco roll/fuel assembly is then joined to a filter by a tipping material.

In the cigarettes of the present invention convective heat is preferably the predominant mode of energy transfer from the burning fuel element to the aerosol generating means disposed longitudinally behind, the fuel element. When a foil/paper laminate is used as an overwrap to join the fuel/substrate section; some heat may be transferred to the substrate by the foil layer. As described above, the heat transferred to the substrate volatilizes the aerosol forming material(s) and any flavorant materials carried by the substrate, and, upon cooling, these volatilized materials are condensed to form a smoke-like aerosol which is drawn through the cigarette during puffing, and which exits the filter piece.

As used herein, the term "aerosol" is meant to include vapors, gases, particles, and the like, both visible and invisible, and especially those components perceived by the smoker to be "smoke-like," formed by the action of heat generated by the fuel element upon materials contained within the aerosol generating means, or elsewhere in the smoking article.

As used herein, the term "carbonaceous" means comprising primarily carbon.

DETAILED DESCRIPTION OF A PREFERRED EMBODIMENT

Figure 1:
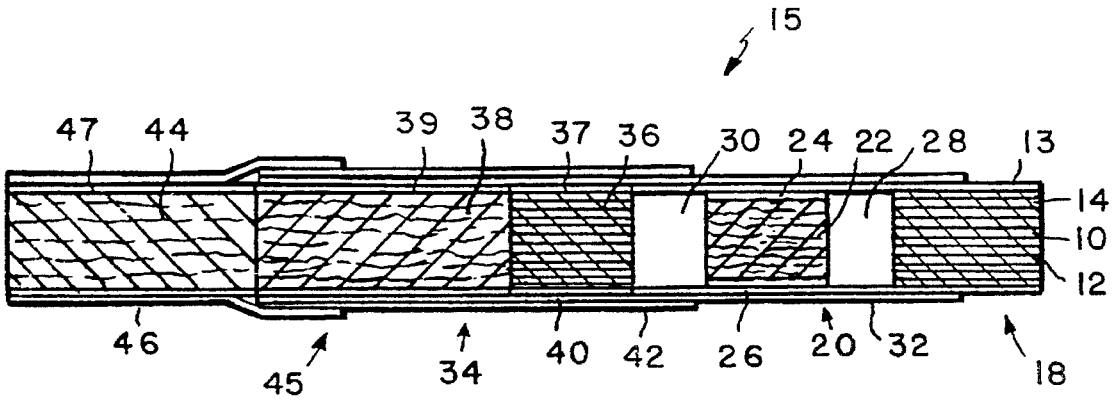
FIGS. 1 and 3 illustrate in sectional view, two embodiments of cigarettes prepared in accordance with the present invention. In these depictions, the thickness of the various overwraps has been increased, for ease in viewing and clarity of structure.
Figure 1A:
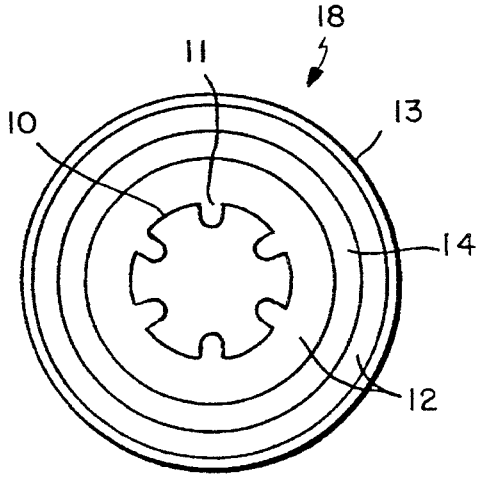
FIG. 1A is an end view of the cigarette shown in FIGS. 1 and 3.
Figure 3:
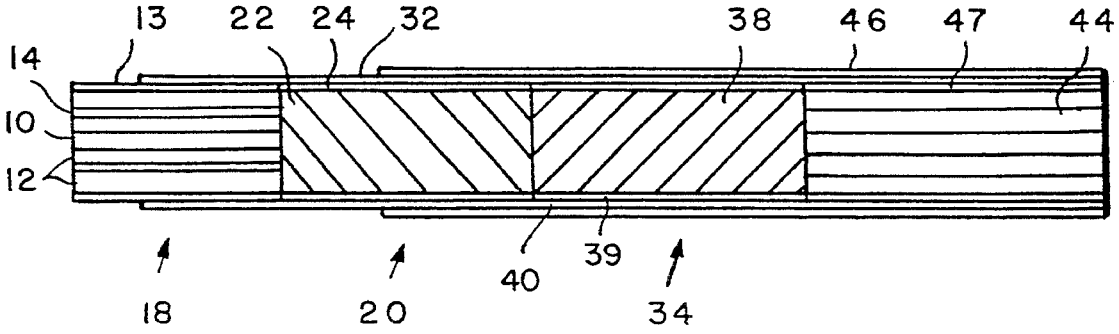

In FIGS. 1, 1A and 3, embodiments of the cigarette 15 of the present invention are illustrated. The cigarette includes a fuel element 10 circumscribed within a retaining jacket of insulating material 12 (e.g., jacketed fuel element 18). The insulating and retaining jacket material 12 comprises glass fibers.

As illustrated in FIG. 1A, the fuel element 10, which preferably is an extruded carbonaceous material, is generally cylindrical in shape and has a plurality of longitudinally extending peripheral channels 11.

The insulating and retaining jacket 12 has an intermediate layer 14 of tobacco paper positioned between two layers of glass fibers. Surrounding the insulating and retaining jacket 12 is paper wrapper 13. Wrapper 13 may comprise one or more layers which provide appropriate porosity and ash stability characteristics.

Situated longitudinally behind the jacketed fuel element 18 is an aerosol generating means. In FIG. 1, the substrate plug 22, advantageously is made from a gathered web of cellulosic material, (e.g., paper or tobacco paper) having a paper overwrap 24. The substrate 22 holds one or more aerosol forming materials (such as glycerin), a form of tobacco (such as tobacco powder, extract or dust), and flavor components, which are volatilized by heat generated by the burning of the fuel element. The substrate 22 is positioned in a barrier tube 26 so that voids 28 and 30 are provided on either end of the substrate plug 22 to form a substrate section or component 20. The spaced apart relationship between the substrate plug and fuel element assists in preventing the substrate from scorching or burning during use of the cigarette, and, along with the barrier tube, aids in preventing migration of the aerosol forming material(s) from the substrate to the fuel element and other components of the cigarettes.

In FIG. 3, the substrate 22 is advantageously made from a reconstituted tobacco cast sheet cut filler material. Such substrates are described in U.S. patent application Ser. No.

07/800,679, filed 27 Nov., 1991, which is incorporated herein by reference.

Besides the above-described substrate rods, other substrate material rods can be shredded puffed grain (e.g., puffed rice), or a tobacco/puffed grain blend, which has an aerosol forming material and binder applied to the puffed grain. The aerosol forming material and binder may be heated to form a gel which is carried by the substrate rod. The shredded and puffed grain carrying the aerosol forming material may be mixed with tobacco dust and formed into overwrapped rods using a cigarette making machine.

Examples of preferred aerosol forming materials include the polyhydric alcohols (e.g., glycerin, propylene glycol, triethylene glycol and tetraethylene glycol), the aliphatic esters of mono-, di-, or poly-carboxylic acids (e.g., methyl stearate, dimethyl dodecandioate and dimethyl tetra decanedioate), Hystar TPF available from Lonza, Inc., and the like, as well as mixtures there. For example, glycerin, triethylene glycol and Hystar TPF can be mixed together to form an aerosol forming material. Also, a propylene glycol/glycerin mixture is used.

Examples of other aerosol forming materials include volatile flavoring agents and tobacco flavor modifiers. Volatile flavoring agents include menthol, vanillin, cocoa, licorice, organic acids, high fructose corn syrup, and the like. Various other flavoring agents for smoking articles are set forth in Leffingwell et al., Tobacco Flavoring For Smoking Products (1972) and in European Patent Publication No. 407,792. Tobacco flavor modifiers include levulinic acid, metal (e.g., sodium, potassium, calcium and magnesium) salts of levulinic acid, and the like.

Circumscribing the jacketed fuel element and spaced from the lighting end thereof is a non-burning or foil-backed (e.g., aluminum or other metal) paper wrapper 32, which also extends over the substrate section 20. Wrapper 32 is preferably a non-wicking material which prevents the wicking of the aerosol forming material(s) from the substrate 22 to the fuel element 10, the insulating jacket 12, and/or from staining of the other components of the cigarettes. This wrapper also minimizes or prevents peripheral air (i.e., radial air) from flowing to the portion of the fuel element disposed longitudinally behind its front edge, thereby causing oxygen deprivation and preventing excessive combustion. While not preferred, wrapper 32 may extend over the burning end of the fuel element 10 (or beyond the same) and be provided with a plurality of perforations (not shown) to allow controlled radial air flow to the burning segment of the fuel element to support combustion.

The void space 30 of the cigarette of FIG. 1 acts as a cooling and nucleation chamber wherein the hot volatile materials exiting the substrate cool down and form an aerosol. If desired, the void space 30 may be filled with a roll of gathered or shredded tobacco paper (not shown). The presence of tobacco paper within the void space contributes tobacco flavors to the aerosol.

Positioned rearwardly and adjacent to the substrate section 20 is a tobacco section or component 34. In FIG. 1, the tobacco section includes a tobacco paper plug 36 with a paper wrapper 37, such as KC P-3284-19, available from Kimberly Clark ("KC"), of Neenah, Wis., and a roll of tobacco cut filler 38 circumscribed by a paper wrapper 39. The tobacco section 34 is overwrapped by a paper wrapper 40. The tobacco paper plug end of the tobacco section 34 abuts the substrate section and is combined thereto by an overwrap paper 42. The overwrap paper 42 extends from the rear end of the tobacco roll 38 to slightly forward of the junction between the tobacco paper plug 36 and the substrate section 20 to form a tobacco/fuel assembly 45.

If desired, a carbon filled sheet containing a flavorant such as menthol can be substituted for or used in conjunction with the tobacco paper plug.

In FIG. 3, the tobacco section 34 is a roll of reconstituted tobacco cut filler 38, circumscribed by paper wrapper 39.

Positioned at the extreme mouth end of the cigarette is a low-efficiency filter element 44 including a filter material, such as a gathered web of non-woven polypropylene fiber, cellulose acetate, or the like, overwrapped with a plug wrap 47. In FIG. 1, the filter abuts the tobacco roll 38 of the tobacco/fuel section 45 and is combined thereto by tipping wrapper 46. In FIG. 3, the filter abuts the tobacco section 34, and is combined with a tipping paper or tipping wrapper 46.

In use, the smoker lights fuel element 10 which burns to produce heat. During draw, air passes along the periphery of the burning portion of the fuel as well as through the retaining and insulating jacket 12. The drawn air is heated by contacting the burning portion of the fuel element and by heat radiated from the fuel element. The heated air transfers heat by convection to the substrate 22. The transferred heat volatilizes the aerosol forming and flavor materials carrier by the substrate. The volatilized material within the hot drawn air exits the substrate. As the volatilized material cools during passage through the remainder of the substrate, through void space 30 (if present), and through the tobacco section, an aerosol is formed. The aerosol passes through the tobacco section, and the tobacco paper plug 36 (if present), absorbing tobacco flavors, and passes through the filter material 44, and into the mouth of the smoker.

Since the rear end portion of the fuel element does not burn during use of the cigarette, the fuel element remains securely in the cigarette and does not have a tendency to become dislodged from the cigarette during use. When the fuel element self-extinguishes and no longer generates heat, the cigarette is disposed of.

Figure 2A:
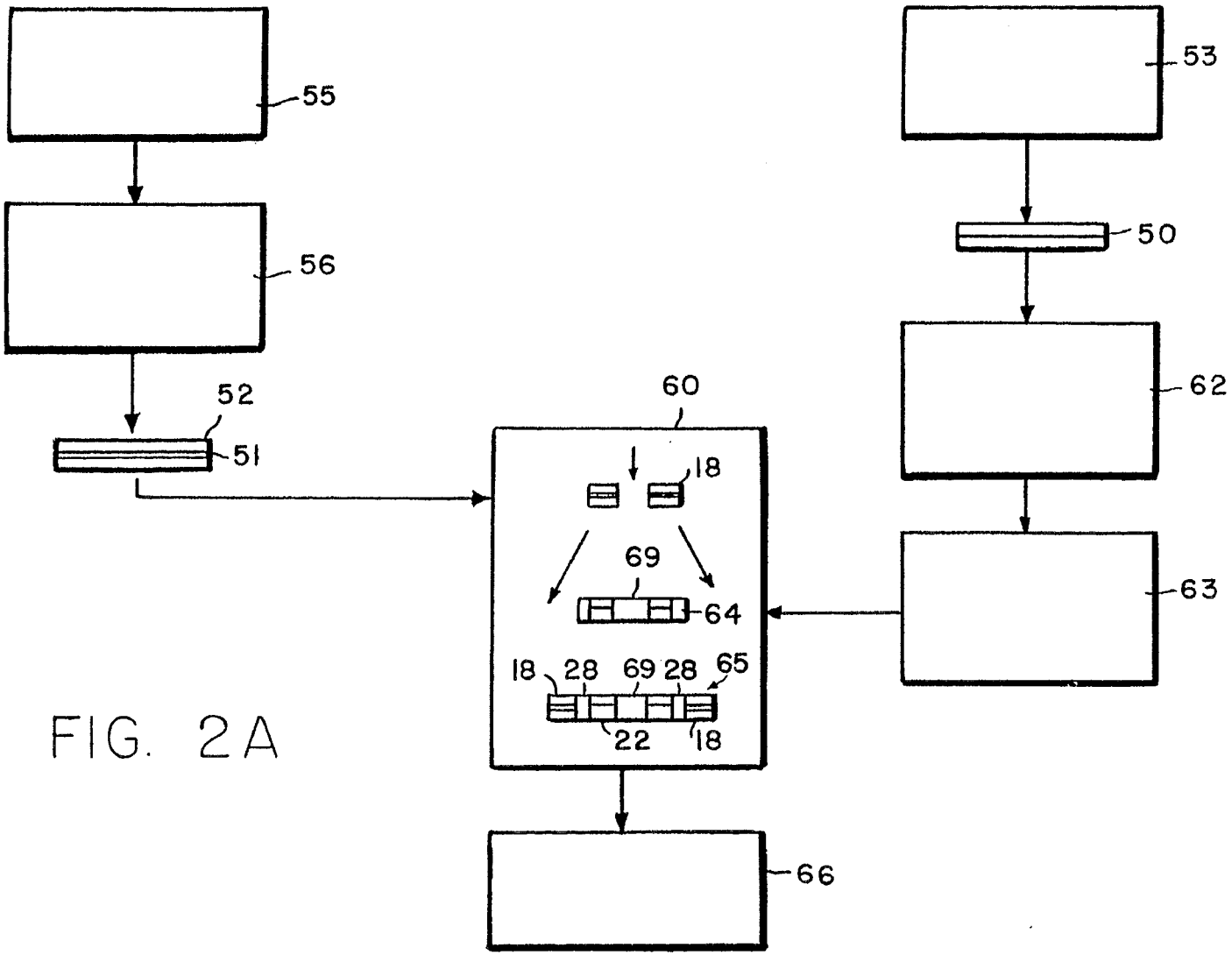
FIGS. 2A, 2B and 2C illustrate a flow diagram of one preferred method for manufacturing the cigarette embodiments of the present invention illustrated in FIG. 1 and FIG. 1A.
Figure 2B:
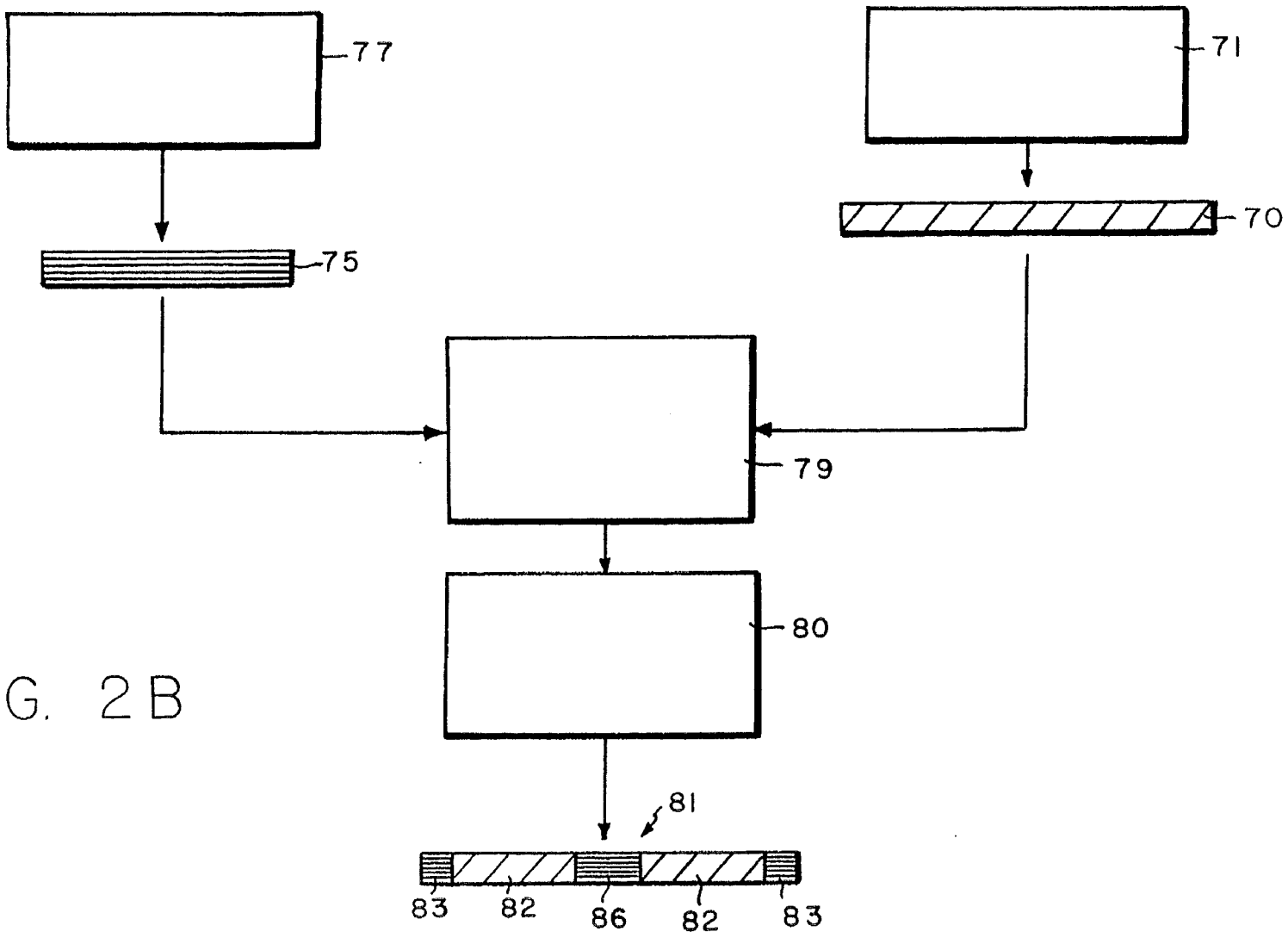
Figure 2C:
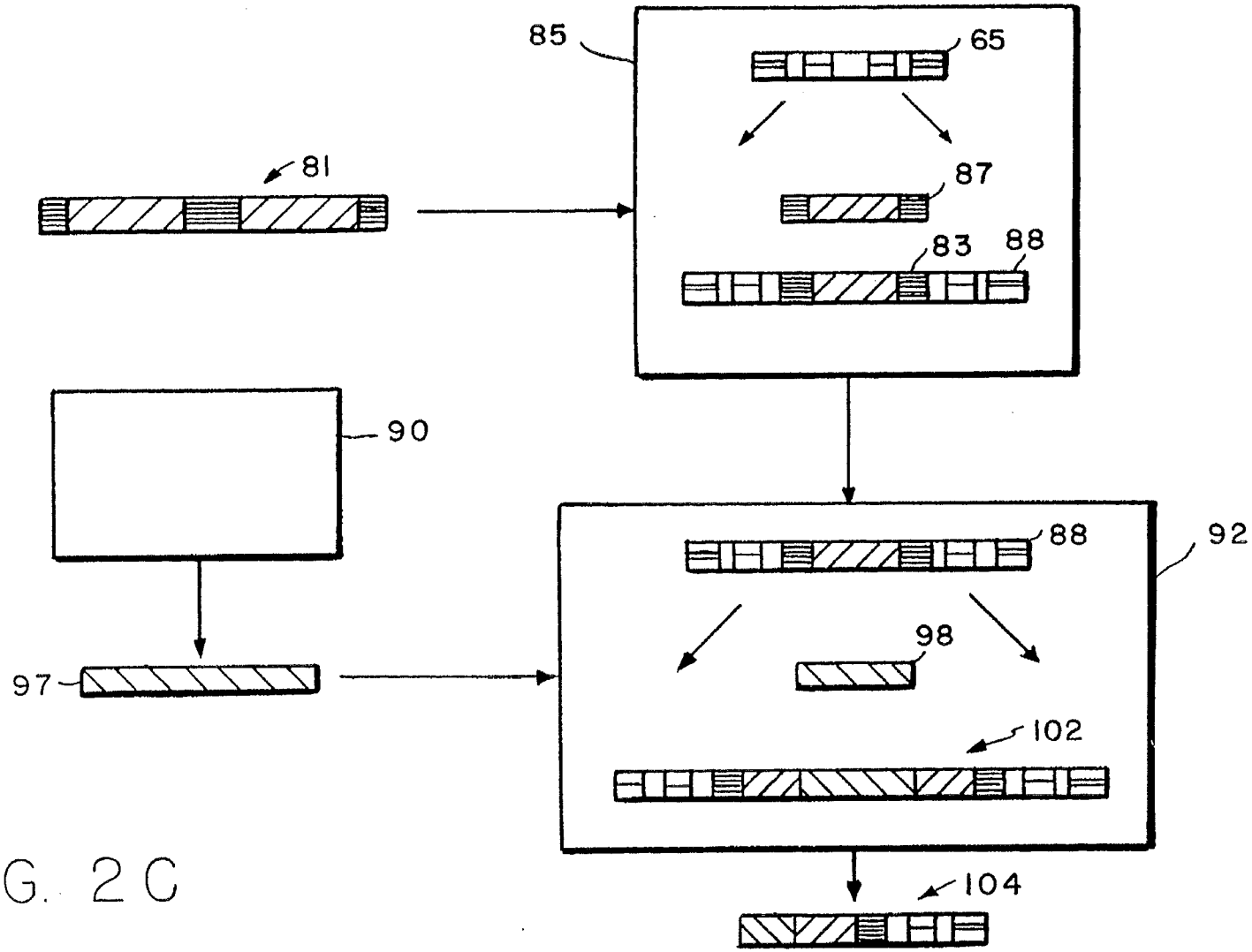

Referring to FIGS. 2A, 2B and 2C, there is shown a flow diagram of one preferred method for manufacturing the cigarette embodiments of the present invention illustrated in FIG. 1 and FIG. 1A. The method involves separately manufacturing the various cigarette components such as the jacketed fuel element, substrate section, tobacco section and filter followed by combining the individually prepared components in a specified sequence.

As illustrated, a substrate rod 50 is formed by gathering a paper-type web materials into a continuous cylindrical rod and overwrapping the continuous rod with a wrapping material. The substrate material is preferably both embossed and gathered to form the substrate rod. The substrate rods can be provided (i) using the apparatus described in U.S. Pat. No. 4,807,809 to Pryor, et al.; (ii) using the apparatus described in U.S. patent application Ser. No. 585,444, filed Sep. 20, 1990; or (iii) using a rod forming unit available as CU-10, CU-20 or CU-20S from Decoufle s.a.r.b., together with a KDF-2 rod making apparatus from Körber & Co., A. G., Hamburg, Germany (Körber). The web material is typically provided with a plurality of embossed lines parallel to the machine direction so that the web gathers in a more uniform pattern.

Preferred substrates retain the aerosol forming material when not in use, and release the aerosol forming material during the smoking period. One preferred type of substrate is a non-woven sheet-like material such as paper, carbon paper or tobacco paper. Typically, such substrates are provided as cylindrical rods including an embossed and gathered web of paper circumscribed by an outer wrapper. Preferred substrates of this type are described in U.S. patent application Ser. No. 07/882,209, filed 13 May 1992, the disclosure of which is incorporated herein by reference. Other types of web substrate materials include laminates, such as paper/foil laminates.

In particular, the continuous web of substrate material is embossed, gathered into a plurality of longitudinally extending folds while having the aerosol forming material continuously applied to the center thereof, to form a rod which is then circumscribed by the outer wrapper.

The substrate may also be formed of a rod having a concentric configuration in which the center core is formed of a paper material which will absorb and retain the aerosol forming material and an outer rind of barrier material which circumscribes the core to assist in limiting migration of the aerosol former.

The outer wrapper which circumscribes the gathered substrate material is preferably a paper material and can be coated or treated with a material so as to limit migration of the aerosol forming material. An example of such a coating is Hercon 70 available from Hercules, Inc., or a metal foil.

The substrate web is gathered to form substrate rods such that the cross-sectional void area of the rod typically ranges from about 5 to about 30 percent, generally from about 8 to about 25 percent, and often about 10 to about 20 percent. The cross-sectional void area (i.e., that area provided by passageways when the rod is viewed end-on) typically can be determined using an image analysis technique using an IBAS Image Analyzer available from Carl Ziess, Inc.

An aerosol forming material may be applied to the substrate material prior to forming or may be introduced into the substrate web through a tube centered in the gathering garniture of the KDF rod making apparatus 53. A metering pump is used to provide a specified amount of aerosol forming material into the substrate web. The continuous substrate rod is cut into substrate rods 50 approximately 60 mm in length and fed into suitable conveying means for conveying the rods to the next assembly station. Suitable conveying means for the various subassemblies described herein include batch conveyors, such as an HCF 80 tray filler, available from Körber, or continuous conveyors, such as pneumatic or other conveyor apparatus known in the art.

A carbonaceous fuel rod 51 is formed utilizing a screw or a piston type extruder 55. A preferred carbonaceous mixture can be prepared by admixing up to 95 parts carbonaceous material, up to 20 parts binder and up to 20 parts of tobacco (e.g., tobacco dust and/or a tobacco extract) and with sufficient water to form a paste, and extruding the paste into the desired form. The water can advantageously be provided in the form of an aqueous $Na_2CO_3$ solution. See also U.S. Pat. No. 07/722,993, filed 28 Jun. 1991, the disclosure of which is incorporated herein by reference. See also the U.S. Patents and patent applications cited as background above, for other examples of carbonaceous mixtures.

Extruded carbonaceous rods can be provided as follows. Carbon particles are provided in a particulate form by ball milling techniques. Tobacco laminae can also be ball milled to a fine particle size (e.g., 5 to 15 μm, preferably 7 to 12 μm—average) and mixed with the carbon particles. Other fuel element components or additives (e.g., calcium carbonate particles or graphite) can be blended with the carbon particles or mixture of carbon and tobacco particles. The particles then are physically mixed with dry, powdered binding agent. Then, the resulting dry blend is physically mixed while an atomized spray of water is applied thereof. The resulting damp mix typically exhibits a moisture content of about 40 to about 40 weight percent wet basis, preferably 32 to 38 and most preferably 34–36. The stated moisture content will depend on the type of extruder used and to some extent on the configuration of the carbonaceous mixture. If desired, water soluble materials or additives (e.g., tobacco extracts, salts, and the like) can be incorporated into the mix by dissolving such materials or additives in the water.

The damp mix is preferably extruded using a compounding extruder (e.g., a double screw compounding extruder). Optionally, the damp mix is extruded into a premixed billets using a Baker-Perkins MP-50-35 DE XLT extruder; and then the billets are extruded into the desired shape using a ram piston extruder, such as an HET-120A from Hydramet American Inc. The mix may also be extruded into the desired shape using a double screw compounding extruder equipped with a screw including a series of forward screw segments, paddle segments and feed screw segments.

Peripheral grooves are included in the finished fuel elements during extrusion. It is preferred that the grooves be deeper than their width, advantageously the depth should be up to about twice (2×) the width. Typical widths for grooves on the fuel elements of this invention are from about 0.25 mm to about 1.5 mm, preferably from about 0.5 mm to about 1.0 mm. The depths of these grooves is generally within the range of about 1 mm to about 1.5 mm. The grooves may have either a rounded (concave or convex) bottom, or a square or rectangular bottom. The preferred shape is a concave bottom.

The extruded mix exits a die as a continuous extrudate having the desired cross-sectional shape, and is deposited onto an airfoil.

The extruded continuous carbonaceous fuel rod 51 is wrapped in an insulating material and outer paper wrapper using a modified KDF 56 as described in U.S. Pat. No. 4,893,637, to form a wrapped fuel/insulator assembly 52. A preferred extrusion and wrapping process is described in U.S. patent application Ser. No. 07/856,239 filed Mar. 25, 1992, the disclosure of which is incorporated herein by reference.

The insulating material preferably will permit drawn air to pass therethrough, and will assist in holding the fuel element in place. In some embodiments, the insulating and/or retaining material is compressed around the fuel element, thereby ensuring a good, stable positioning and snug fit of the fuel element therein. Typically, in preferred embodiments the pectin binder in the glass fiber insulating material is reactivated by applying water so that the insulating material will adhere to the fuel element upon drying.

The composition of the insulating and/or retaining material which surrounds the fuel element can vary. This material is preferably one which has a tendency not to combust or a material which combusts but does not disintegrate. Examples of suitable materials include glass fibers and other materials of the type described in U.S. patent application Ser. No. 07/601,551, filed Oct. 23, 1990; European Patent Publication No. 366,690; and pages 48–52 of the monograph entitled, Chemical and Biological Studies of New Cigarette Prototypes That Heat Instead of Burn Tobacco, R. J. Reynolds Tobacco Co. (1988).

Examples of other suitable insulating and/or retaining materials are glass fiber and tobacco mixtures such as are described in U.S. Pat. No. 4,756,318 to Clearman et al. and U.S. Pat. No. 5,065,776.

As illustrated in FIGS. 1 and 1A, the insulating and/or retaining material which surrounds the fuel element is circumscribed by a paper wrapper. This paper wrapper may comprise one or two layers, which may vary in air permeability and ash stability characteristics. Papers having these characteristics are described in U.S. Pat. No. 4,938,238 to Barnes et al. and U.S. patent application Ser. No. 07/574,327 by Barnes et al. An example of a suitable outer paper wrapper is available as P-3122-153 from Kimberly-Clark Corp. and No. 15456 Ecusta, a division of P. H. Gladfelder.

Upon leaving the extrusion process, the moisture content of the carbonaceous fuel rod 51 is about 30 to 38 percent by weight. After the fuel is overwrapped, the wrapped continuous fuel rod is cut to form a 6-up jacketed fuel rod 52 approximately 72 mm in length. If desired, at this point in the manufacturing process the jacketed fuel rod may be dried to reduce the moisture content of the carbonaceous rod. Preferably the moisture content should be maintained at an appropriate level so that the carbonaceous rods can be cut during subsequent manufacturing steps without fracturing or chipping. Normally, a moisture content between 38 and 12 percent is acceptable. The dryer used (not shown) can be a passive drying apparatus such as a timed accumulator system (e.g., a Resy available from Körber, or S-90, available from G.D Societe Per Azioni, Bologna, Italy, optionally in a humidity controlled environment) or a positive drying system such as a hot air blower system. The jacketed fuel rods are fed to a tipping unit 60 such as a Max R-1 available from Körber.

The 60 mm substrate rods 50 are fed into a plug tube combining apparatus such as a Mulfi R-1, consisting of a GC unit 62 and a KDF-2D unit 63 available from Körber. The substrate rods are cut into 10 mm plugs, which are then graded, aligned and spaced at intervals about 10 mm in the GC unit. Pairs of spaced 10 mm plugs are transferred to the KDF-2D unit at intervals of about 12 mm and aligned. The spaced plugs 22 are overwrapped with a wrapper 26 (FIG. 1) which forms a tube having substrate plugs spaced at 10 mm and 12 mm intervals. The tube is cut through about the midpoint of the 10 mm spaces to form a 2-up substrate tube 64 about 42mm in length having a void space at each end approximately 5 mm in length, two substrate plugs approximately 10 mm in length and a void space 69 of about 12 mm between the two substrate plugs.

The overwrap material is preferably a foil/paper laminate. The foil layer providing an additional barrier to aid in preventing migration of the aerosol forming material. The wrapper material is designed so that upon forming a tube that will not bend or collapse during the manufacturing process or during use of the cigarette.

Advantageously, the KDF-2D 63 of the plug tube combiner is directly linked to the tipper 60 so that the substrate tubes 64 are transferred to an appropriate drum on the tipper. The tipper 60 also receives the jacketed fuel rods 52 from the previously described fuel extrusion process. In the tipper 60, the 72 mm jacketed fuel rods, or 6-up jacketed fuel rods are cut into lengths of about 12 mm to form jacketed fuel elements 18. The jacketed fuel elements are then graded, aligned with a pair being spaced and positioned on opposite ends of a substrate tube 64 with a jacketed fuel element 18 adjacent to the void 28 and on each end of the substrate tube 64. The aligned components are overwrapped with a wrapper or tipping material 32 (FIG. 1) to form a 2-up fuel/substrate section 65, approximately 66 mm in length, having a fuel element 18 at each end, two void spaces 28, two substrate plugs 22 and a center void space 69. Preferably, the tipping material 32, is about 54 mm in length by about 26 mm in width and is applied to the 2-up fuel substrate section 65 so that approximately 6 mm of each of the jacketed fuel elements extend beyond the edge of the tipping material and, thus is not covered by the tipping material. The tipping material is preferably a paper/foil/paper laminate.

When the fuel/substrate section 65 exits the tipper 60, the section passes through drying stage 66 to dry the carbonaceous fuel elements. Drying can be accomplished in a passive manner using an accumulator such as a Resy or S-90 optionally in a humidity controlled environment or a positive heating process. The heating process should not be so great that the aerosol forming material and other flavorants will be volatilized off the substrate. Preferably, the carbonaceous fuel is dried to a moisture content of approximately 12 to 14 percent by weight. If desired, the drying stages can be eliminated and relocated since they depend on the moisture content of the extruded rod and the time lapse between the different stages in the manufacturing process.

Preferably, simultaneously with the manufacture of the fuel/substrate section 65, tobacco section 34 (FIG. 1) of the cigarette 5 is being made, as shown in FIG. 2B. A continuous tobacco rod is formed on a cigarette making machine 71 such as a Protos VE/SE available from Körber using a cut filler material such as tobacco, reconstituted tobacco or the like. The continuous tobacco rod is cut into lengths of 120 mm forming tobacco rolls or rods 70.

The tobacco cut filler rod is joined to a plug of tobacco paper, shown at 34 in FIG. 1. The tobacco paper plug is obtained from a continuous tobacco paper rod as described in prior U.S. Pat. No. 4,807,809. The tobacco paper rods are wrapped with suitable cigarette paper using a web feeder apparatus and a modified KDF 77, as therein described, and are cut into tobacco paper rods 75 about 80 mm in length.

The 120 mm tobacco rod 70 and the 80 mm tobacco paper rod 75 are fed into the hoppers of a plug tube combiner such as a Mulfi R-2, including a GC unit 79 and a KDF-2D 80. The tobacco rod and tobacco paper rods are cut into segments of 40 mm and 20 mm, respectively. The segments are graded and aligned in the GC unit in an alternating abutting position upon transfer to the KDF-2D where the rod segments are overwrapped with paper and cut into cut filler/tobacco paper assemblies or 4-up tobacco sections 81 having a center 20 mm tobacco paper rod 86 between a pair of 40 mm tobacco cut filler segments 82 with 10 mm tobacco paper segment 83 on each end.

As shown in FIG. 2C, the 4-up tobacco section 81 is fed into a tipping unit 85 such as a Max R-2 tipper available from Körber. In the tipper, the 4-up section 81 is cut at its midpoint through tobacco paper segment 86 to form a 2-up tobacco section 87 having a 40 mm tobacco roll center segment and 10 mm tobacco paper segments at each end. The 2-up tobacco sections 87 are graded and aligned.

The 2-up fuel/substrate sections 65 are fed to tipper 85 which cuts the 2-up fuel substrate section 65 at its mid-point through the substrate tube, grades, aligns and positions the two halves on opposite sides of a tobacco section 87 with the void 30 (FIG. 1) of the fuel/substrate section adjacent the tobacco paper segments 83. This assembly of components is then overwrapped with a suitable wrapper 42 (FIG. 1) to form 2-up tobacco/fuel units 88 approximately 126 mm in length having the fuel element disposed at opposite ends. The edge of the wrapper 42 extends beyond the abutment point of the fuel substrate unit 32 and the tobacco section 87. The 2-up tobacco/fuel unit is conveyed to a tipping unit 92 such as a Max R-3 available from Körber.

Filter material, such as non-woven polypropylene web, is formed into a continuous rod using a web feeder and KDF (90) filter maker described in U.S. Pat. No. 4,807,809. The continuous filter rod is cut into 4-up filter segments 97 approximately 80 mm in length. The 4-up filter segments 97 is passed to the tipper 92. In the tipper 92, the 4-up filter segments 97 are cut into 2-up filters 98 approximately 40 mm in length graded and aligned. The 2-up tobacco/fuel unit 88 is cut at its midpoint through the tobacco roll segment 82 graded, aligned, and single units are positioned on opposite sides of a 2-up filter 98. A tipping paper 46 is applied by the Max R-3 (Körber) to the assembled components, attaching the 2-up filter 98 between the tobacco/fuel units to form a 2-up cigarette 102. The 2-up cigarette 102 is then cut through the midpoint of the filter segment 98 to form single cigarette 104. Alternate cigarettes 104 are rotated 180° to align so that all of the cigarettes have the same orientation. The cigarettes 104 may then be transferred to an HCF tray filler 106 or into an accumulator such as a Resy which may be connected to packaging equipment.

Figure 4C:
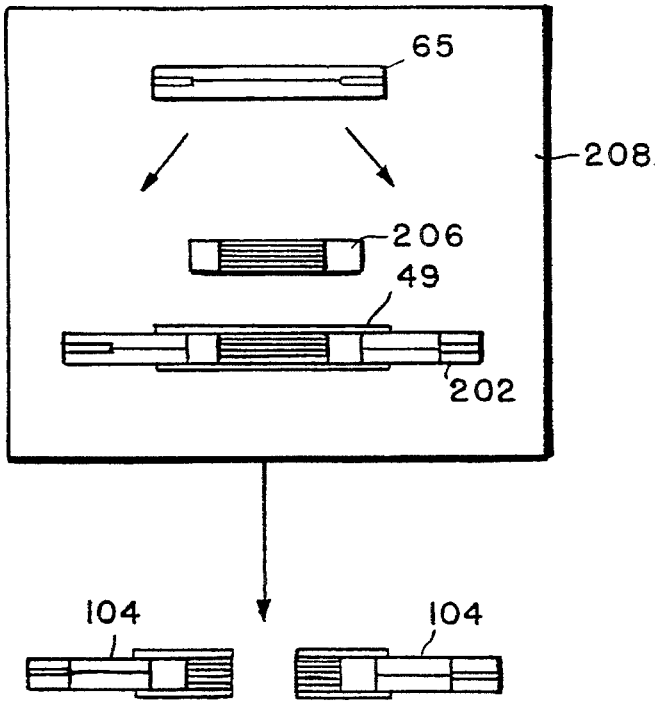
FIGS. 4A, 4B and 4C illustrate a flow diagram of one preferred method of manufacturing the cigarette of the present invention illustrated in FIG. 3.
Figure 4A:
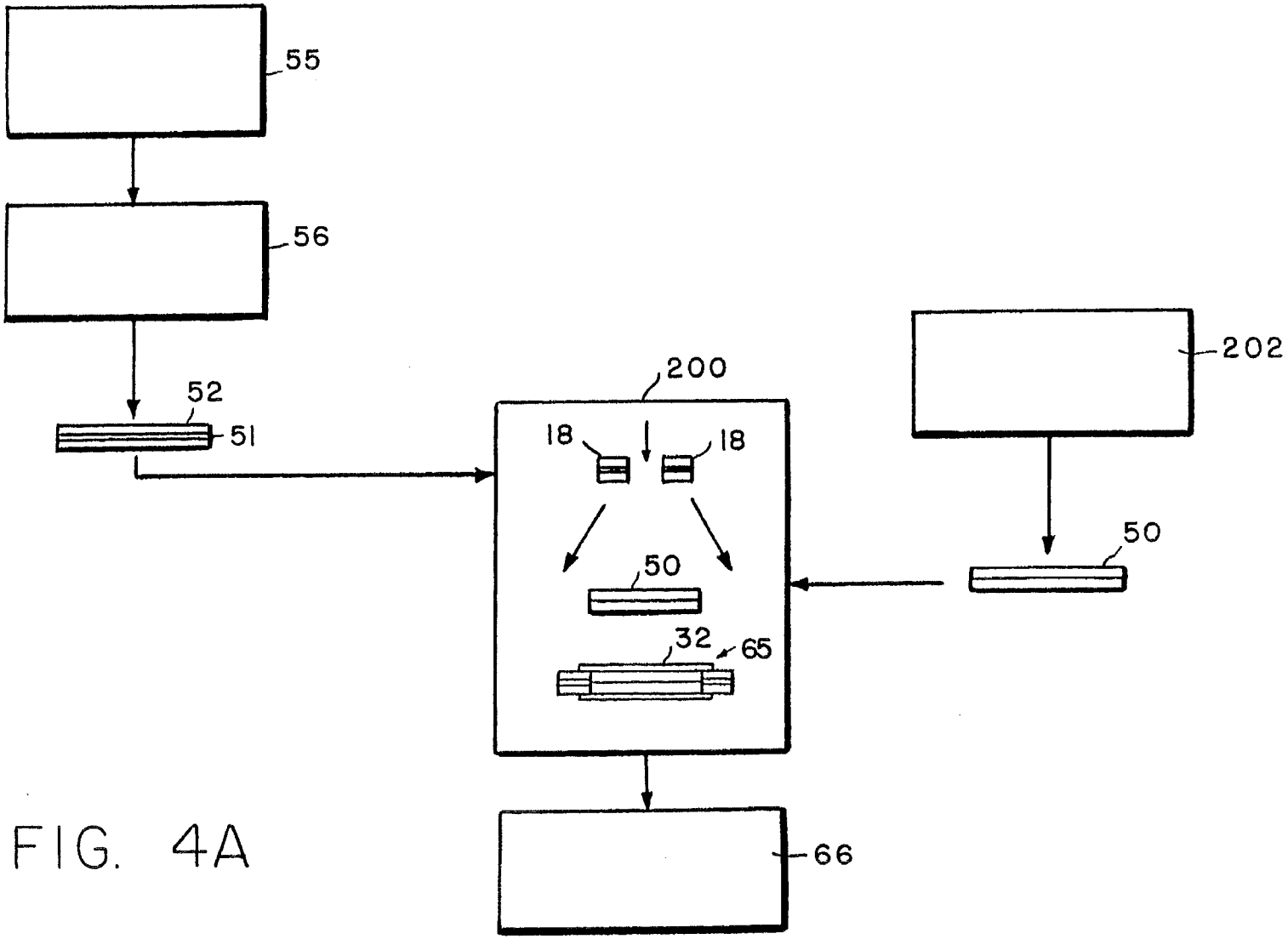
Figure 4B:
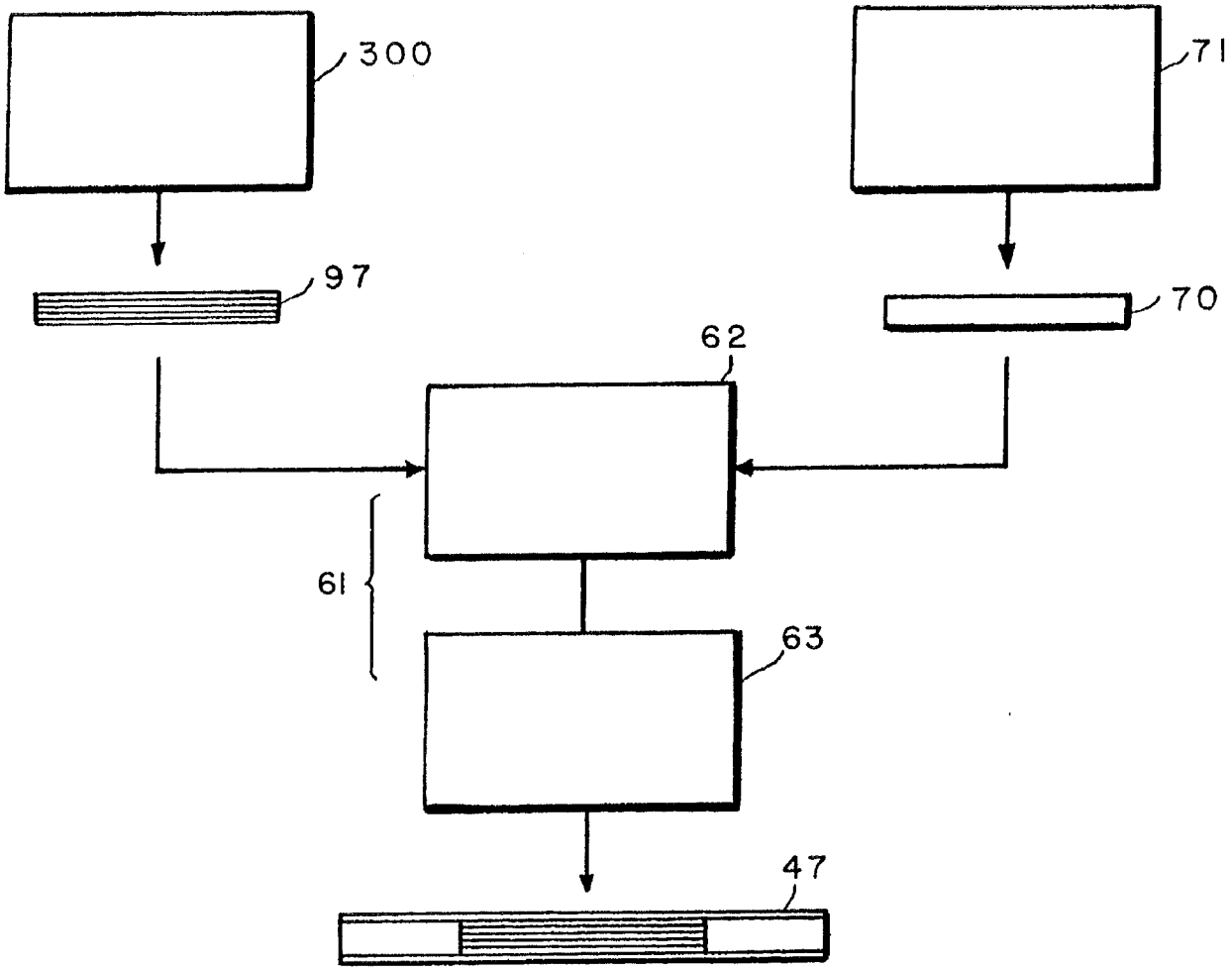

Referring to FIGS. 4A, 4B and 4C, there is shown a flow diagram of a preferred method of manufacturing the cigarette embodiment of the present invention illustrated in FIG. 3 and 1A. Again the method involves separately manufacturing the various cigarette components, and combining the individually prepared components in a specified sequence. The method illustrated in FIGS. 4A, 4B and 4C is a simplified method.

The jacketed fuel element 52 is prepared as previously described with the method illustrated in FIG. 2, and cut into 72 mm or 6-up lengths, and fed into a Max 1 tipper unit 200, available from Körber.

The substrate rod 50 is formed by providing a reconstituted tobacco cast sheet material as described in Example 2 herein. The cut filler material is formed into a continuous rod and overwrapped with a wrapper using a cigarette making machine 202 such as a Protos, available from Körber, and cut into rod lengths of 62 mm or 2-up lengths, and transferred to a hopper of the Max 1 Unit 200.

In the tipper unit 200, the 72 mm jacketed fuel rods are cut into lengths of about 12 mm to form jacketed fuel elements 18. As described previously, the jacketed fuel elements 18 are combined with substrate 50 using an overwrap 32, similarly to the method of FIG. 2. The overwrap 32 is approximately 74 mm in length, and is applied so that its edges are spaced approximately 6 mm from the free ends of each of the jacketed fuel elements 18, to form a 2-up fuel substrate section 65.

Preferably, simultaneously with the manufacture of the fuel/substrate section 65, tobacco section 34 (FIG. 3) of the cigarette 5 is being made, as shown in FIG. 4B. A continuous tobacco rod is formed on a cigarette making machine 71 such as a Protos VE/SE available from Körber using a cut filler material such as tobacco, reconstituted tobacco or the like. The continuous tobacco rod is cut into lengths of 80 mm (4-up) forming tobacco rolls or rods 70.

Filter material, such as a low efficiency cellulose acetate tow, is formed into a continuous rod using a KDF filter making machine 300, and cut into 4-up filter segments 97, approximately 80 mm in length.

The 4-up tobacco rods 70 and the 4-up filter segments 97 are transferred to a combining apparatus 61, such as a Mulfi, consisting of a GC unit 62 and a KDF-2D unit 63 available from Körber. The tobacco rod 70 and filter segments 97 are cut into 40 mm lengths, and are alternately positioned in the GC unit, graded and aligned, and transferred to the KDF-2D unit. There they are overwrapped, and cut into 2-up tobacco filter sections 206, about 80 mm in length. The 2-up tobacco filter sections have a 40 mm center filter segment and 20 mm tobacco segments on each end.

As shown in FIG. 4C, the 2-up tobacco filter unit 206 and the 2-up fuel substrate section 65 are transferred to a second tipper unit 208 (See FIG. 4C) such as a Max 2, available from Körber. The 2-up fuel substrate sections 65 are cut at approximately their midpoints, and graded, and aligned with a single fuel substrate section, where they are spaced and positioned at opposite ends of a tobacco filter section 206, with the substrate adjacent the tobacco section. The aligned components are overwrapped with a tipping material 49, RJR Type 1000011, to form a 2-up cigarette 202. The 2-up cigarette is then cut at approximately the midpoint of the filter to form a single cigarette 104. Alternate cigarettes are rotated 180° so that all of the cigarettes have the same orientation. The cigarettes may be transferred to a HCF tray filler, or to an accumulator such as a Resy, which may be connected to standard cigarette packaging equipment.

The present invention will be further illustrated with reference to the following examples which aid in the understanding of the present invention, but which are not to be construed as limitations thereof. All percentages reported herein, unless otherwise specified, are percent by weight. All temperatures are expressed in degrees Celsius.

EXAMPLE 1

PREPARATION OF COMPONENTS

Jacketed Fuel Rod

A jacketed fuel rod approximately 7.5 mm in diameter, including a carbonaceous fuel rod and an insulating material is prepared by directly extruding the carbonaceous fuel rod into a multilayer glass fiber/tobacco paper ribbon in accordance with the process described in U.S. patent application Ser. No. 07/856,239, filed 25 Mar., 1992. The jacketed fuel rod is cut into lengths of about 72 mm.

Carbonaceous Fuel Rod

The carbonaceous fuel rod having an apparent (bulk) density of about 1.02 g/cc is prepared from about 73.4 parts hardwood pulp carbon having an average particle size of 12 micron diameter, 10 parts ammonium alginate (Amoloid HV, Kelco Co.), 0.2 parts $Na_2CO_3$, 8.4 parts graphite about 8 microns in particle size, 3 parts $Ca_2CO_3$ powder, and 5 parts, ball-milled American blend tobacco.

The hardwood pulp carbon is prepared by carbonizing a non-talc containing grade of Grande Prairie Canadian kraft hardwood paper under nitrogen blanket, increasing the temperature in a step-wise manner sufficient to minimize oxidation of the paper, to a final carbonizing temperature of at least 750° C. The resulting carbon material is cooled under nitrogen to less than 35° C., and then ground to fine powder having an average particle size of about 12 microns in diameter.

The finely powdered hardwood carbon is dry mixed with the ammonium alginate binder, levulinic acid and the tobaccos, and then a 3% wt. aqueous solution of $Na_2CO_3$ is added to provide an extrudable mixture, having a final sodium carbonate level of about 0.9 parts.

The carbonaceous fuel rods are extruded using a screw extruder from the mixture having a generally cylindrical shape about 4.2 mm in diameter, with size (6) equally spaced peripheral grooves (about 0.5 mm wide and about 1 mm deep) with rounded bottoms, running from end to end. The extruded rods have an initial moisture level ranging from about 36–38 weight percent.

Jacket Material

The jacket material is composed of 2 layers of Owens-Corning C-glass mat, each about 1 mm thick prior to being compressed by a jacket forming machine (e.g., such as that described in U.S. Pat. No. 4,807,809), and after formulation, each being about 0.6 mm thick. Sandwiched between the two layers of C-glass is one or two sheets of reconstituted tobacco paper, Kimberly-Clark's P-3510-96-2. A cigarette paper, designated P-3122-153 from Kimberly-Clark, overwraps the outer layer. The reconstituted tobacco paper sheet, is a paper-like sheet containing a blended tobacco extract. The width of the reconstituted tobacco sheets prior to forming is about 17 mm, and the width of the cigarette paper outer sheet is about 25.5 mm. The seam adhesive used for the outer wrap can be a cold seam adhesive CS 1242, available from RJR Packaging, R. J. Reynolds, Winston-Salem, N.C.

Substrate Tube

A continuous substrate rod about 7.5 mm in diameter is formed from a wide, highly embossed, 36 gsm, about 7 inch wide web of paper containing 25% calcium sulfate available from Kimberly-Clark (K-C) as P3284-19, e.g., on a modified KDF-2 rod forming apparatus. The substrate rod is overwrapped with a paper/foil laminate having a width of about 24.5 mm, the foil being a continuous cast 0.0005 aluminum foil, and the paper being a Simpson Paper Co. ("Simpson") RJR 002A paper. The lamination adhesive is a silicate adhesive, No. 06-50-05-0051, available from RJR Packaging. A center line adhesive, cold adhesive CS 1242M, available from RJR Packaging, is spray applied to the laminate, to hold the substrate in place within the wrap. The seam is sealed with hot melt adhesive 444-227, from RJR packaging.

The overwrapped rod is cut into 60 mm segments. Approximately 900 mg of an aerosol forming material comprising glycerin, propylene glycol, and flavorants, such as tobacco extract, is applied to the web during formation of the continuous substrate rod. The substrate segment is cut into substrate plugs about 10 mm in length and overwrapped with a Simpson RJR 002A/0005 foil laminate described above, having a width of about 25.5 mm. The plugs are placed at alternate intervals of 10 and 12 mm along the tube. The plugs are adhered to the tube by corresponding application of hotmelt adhesive No. 448-37A, RJR Packaging. The seam is sealed with hot melt adhesive 444-227, from RJR Packaging.

The continuous tube is cut into substrate void tube sections about 42mm in length having a center void about 12 mm, two substrate plugs 10 mm wide, and void space at each end of about 5 mm in width.

Tobacco Section

A reconstituted tobacco cut filler prepared as described in U.S. patent application Ser. No. 07/710,273 filed Jun. 14, 1991, is formed into a rod about 7.5 mm in diameter and overwrapped with paper, e.g. KC 646, 25.5 mm in width, using a Protos cigarette making machine, using a standard tipping adhesive. The overwrapped tobacco roll is cut into 120 mm length segments.

A tobacco paper rod about 7.5 mm in diameter is formed from a medium embossed, 127 mm wide web of tobacco paper designated as P-144-GNA-CB available from Kimberly-Clark, e.g., using a rod forming apparatus such as that disclosed in U.S. Pat. No. 4,807,809. The rod is overwrapped with a KC paper P1487-184-2, about 25 mm wide, and cut into 80 mm length segments.

The tobacco roll and tobacco paper segments are cut into 40 mm and 20 mm segments respectively and are aligned in an alternating arrangement and overwrapped with a wrapper of KC 646 paper, 25.5 mm in width, using a center line hot melt adhesive 448-37A, RJR Packaging, and a seam adhesive, 448-195K hot melt, RJR Packaging. The combined tobacco roll/tobacco paper assembly is cut into a 2-up tobacco section 60 mm in length having a 40 mm tobacco roll center segment and 10 mm tobacco paper segment on each end of the tobacco roll segment.

Filter

A polypropylene filter rod about 7.5 mm in diameter is formed from a PP-100 mat, about 260 mm wide, available from Kimberly-Clark and overwrapped with a 25.5 mm width web of paper P1487-184-2, available from Kimberly-Clark, e.g., using the apparatus described in U.S. Pat. No. 4,807,809, and hot melt 448-195K seam adhesive. The overwrapped rod is cut into 80 mm length segments.

CIGARETTE ASSEMBLY

Fuel Substrate Section

A jacketed fuel rod is cut into fuel elements 12 mm in length. Two fuel elements are positioned on opposite sides of a substrate void tube section, and aligned. These components are overwrapped with a wrapper about 26.5 mm in width and about 54 mm in length, comprising a paper/foil/paper laminate, comprising Ecusta 15456 paper/continuous cast 0.0005 foil/Ecusta 29492 paper, which are laminated to the foil using Airflex Adhesive 465. The laminate is adhered to the jacketed fuel and the substrate void tube assembly, by cold adhesive MT-8014, RJR Packaging, applied to the entire inner surface of the laminate. The wrapper overwraps the substrate tube and extends to within about 6 mm of the free end of each fuel element to form a 2-up fuel substrate section.

Tobacco Fuel Unit

A 2-up fuel/substrate section is cut at its midpoint and positioned on opposite sides of a 2-up tobacco section and aligned so that the void end of each fuel-substrate section is adjacent and abuts the tobacco paper plugs at each end of the 2-up tobacco section. The assembled components are overwrapped with Ecusta E30336 paper, about 70 mm in length and about 26 mm wide. The wrapper is adhered to the fuel substrate section and the tobacco section with MT-8009 adhesive, RJR Packaging, to form a 2-up tobacco-fuel unit approximately 126 mm in length.

Cigarette

A 2-up tobacco-fuel unit is cut at its midpoint and positioned on opposite sides of a 2-up filter unit and aligned so that the tobacco roll end of a single tobacco-fuel unit is adjacent and abuts the 2-up filter. The assembled components are overwrapped with a tipping wrapper, RJR tipping code No. 1000011, approximately 50 mm in length and about 26 mm in width which extends approximately 5 mm over each of the junctures between the 2-up filter and each tobacco-fuel unit. The wrapper is adhered over its entire area to the assembled components with an adhesive MT-8009, RJR Packaging, 100% coverage, to form a 2-up cigarette. The 2-up cigarette is cut at approximately its midpoint (i.e., the midpoint of the 2-up filter) to form a single cigarette.

EXAMPLE 2

PREPARATION OF COMPONENTS

Jacketed Fuel Rod

A fuel element about 4.2 mm in diameter, and having an apparent (bulk) density of about 1.02 g/cc is prepared from about 72.6 parts hardwood pulp carbon having an average particle size of 12 μmin diameter, 10 parts ammonium alginate (Amoloid HV, Kelco Co.), 8.4 parts graphite powder, 1 part $Na_2CO_3$ parts $CaCO_3$, and 5 parts ball-milled American blend tobacco.

The hardwood pulp carbon is prepared by carbonizing a non-talc containing grade of Grande Prairie Canadian kraft hardwood paper in an inert atmosphere, increasing the temperature in a step-wise manner sufficient to minimize oxidation of the paper, to a final carbonizing temperature of at least 750° C. The resulting carbon material is cooled in the inert atmosphere to less than 35° C., and then ground to fine powder having an average particle size (as determined using a Microtrac Analyzer, Leeds & Northrup) of about 12 mm in diameter.

The finely powdered hardwood carbon is dry mixed with the graphite, $CaCO_3$, ammonium alginate binder, levulinic acid and the tobaccos, and then a 3 weight percent aqueous solution of $Na_2CO_3$ is added to provide an extrudable mixture, having a final sodium carbonate level of about 1 part.

A jacketed fuel rod is prepared by directly extruding the carbonaceous fuel rod into a multilayer glass fiber/tobacco paper ribbon in accordance with the process described in U.S. patent application Ser. No. 07/856,239, filed 25 Mar., 1992. The jacketed fuel rod is cut into lengths of about 72 mm.

Jacket Material

The jacket material is composed of 2 layers of Owens-Corning C-glass mat, each about 1 mm thick prior to being compressed by a jacket forming machine (e.g., such as that described in U.S. Pat. No. 4,893,637), and after formulation, each being about 0.6 mm thick. Sandwiched between the two layers of C-glass is one or two sheets of reconstituted tobacco paper, Kimberly-Clark's P-3510-176-60. A cigarette paper, designated No. 15456, from Ecusta overwraps the outer layer. The reconstituted tobacco paper sheet, is a paper-like sheet containing a blended tobacco extract. The width of the reconstituted tobacco sheets prior to forming is about 17 mm, while the width of the cigarette paper outer sheet is about 25.5 mm. The seam adhesive used for the outer wrap can be a cold seam adhesive CS 1242, available from RJR Packaging, Winston-Salem, N.C.

Substrate Rod

A cast sheet material is provided by casting an aqueous slurry of components from a headbox at a nominal thickness of about 30 mils onto a heated stainless steel belt. The cast slurry has a solids content of about 12 percent. The slurry is provided by dispersing in water about 32 parts of tobacco pulp in the form of extracted stems and laminae, about 8.75 parts flue-cured tobacco laminae, about 8.75410 parts burley tobacco laminae, and about 14.5 parts extracted burley stems. As such, a slurry having about 1 part tobacco and about 8 parts water is provided. The resulting slurry is refined using a disc refiner, and transferred to a mixer. To the slurry, which includes about 32 parts tobacco, is added about 55 parts glycerin; about 6 parts of the type of tobacco extract described in Col. 11, lines 5–37 of U.S. Pat. No. 5,159,942 to Brinkley et al diluted in water in an amount of about 8 parts extract and about 92 parts water; and about 2 parts of a commercial flavorant, such as Lovage flavorant. However, the selection and relative amounts of those components, such as flavors and tobacco extracts, can vary as desired to provide the desired organoleptic characteristics.

The resulting slurry is mixed to yield a consistent character. Then, about 5 parts ammonium alginate available as Amoloid HV from Kelco Division of Merck & Co., Inc. is added to the slurry. The resulting slurry is thoroughly mixed at ambient conditions using a Breddo Likwifier high shear propeller mixer. The slurry is cast onto a stainless steel belt heated at about 220° F. The dried cast slurry is diced and cut into cut filler size of about 25 cuts per inch. The cut filler is conditioned to yield a substrate having a moisture content of about 15 percent and a thickness of about 6 mils.

The cast sheet substrate material is formed into rods using a rod forming apparatus such as a Protos from Körber. The substrate rod includes a paper/aluminum foil laminate overwrap having a width of about 25.5 mm, the foil being cast aluminum, 0.0005 inches thick, and the paper is available as Ref. 29492 from Ecusta. The laminate is formed with a silicate adhesive, designated as RJR LAM-1-5001, available from RJR Packaging. The laminated paper is formed into a tube (with the foil on the inside) by lap joining using a CS1242 adhesive, available from RJR Packaging. The overwrapped rod is cut into 62 mm long segments. The 62 mm rod weighs about 800 mg.

Tobacco Section

A reconstituted tobacco cut filler prepared as described in U.S. patent application Ser. No. 07/710,273 filed Jun. 14, 1991, is formed into a rod about 7.5 mm in diameter and overwrapped with paper, e.g. Ecusta No. 15456, 25.5 mm in width, using a Protos cigarette making machine, using a standard seam adhesive. The overwrapped tobacco roll is cut into 80 mm length segments.

Filter

A cellulose acetate filter rod about 7.5 mm in diameter is formed from a 10/35,000 Denier cellulose acetate tow containing 0.6% triacetin, and overwrapped with a web of 646 plug wrap, about 25.5 mm in width, available from Kimberly-Clark or Ecusta on a standard filter rodmaker. The overwrapped rod is cut into 80 mm length segments.

CIGARETTE ASSEMBLY

Fuel Substrate Section

A jacketed fuel rod is cut into fuel elements 12 mm in length. Two fuel elements are positioned on opposite sides of a substrate section and aligned. These components are overwrapped with a wrapper about 26.5 mm in width and about 74 mm in length, comprising a paper/foil/paper laminate, comprising Ecusta 99952 paper/continuous cast 0.0005 inch thick aluminum foil/Ecusta 99951 paper, which are laminated to the foil using RJR LAM-5001 (1.0 lbs/ream) available from RJR Packaging. The laminate is adhered to the jacketed fuel and the substrate assembly, by cold adhesive MT-8009B, RJR Packaging, applied to the entire inner surface of the laminate. The wrapper overwraps the substrate tube and extends to within about 6 mm of the free end of each fuel element to form a 2-up fuel substrate section.

Tobacco/Filter Section

An 80 mm tobacco roll and an 80 mm filter segment are cut into 40 mm sections, and are alternately aligned and overwrapped with a wrapper about 25.5 mm in width, e.g., Type 646 from Kimberly-Clark, using a standard seam adhesive. The resulting rod is cut into 80 mm segments having a 40 mm center filter segment, with 20 mm tobacco rolls on opposite ends to form a 2-up tobacco filter section.

Cigarette

A 2-up fuel-substrate section is cut at its midpoint and positioned on opposite sides of a 2-up tobacco filter section, and aligned so that the substrate end of a single fuel-substrate unit is adjacent and abuts the tobacco roll of the 2-up tobacco-filter section. The assembled components are overwrapped with a tipping wrapper, RJR tipping code No. 1000011, approximately 90 mm in length and about 26 mm in width which extends approximately 5 mm over each of the junctures between the 2-up tobacco-filter and each fuel-substrate unit. The wrapper is adhered over its entire area to the assembled components with an adhesive MT-8009 (RJR Packaging) 100% coverage, to form a 2-up cigarette. The 2-up cigarette is cut at approximately its midpoint (i.e., the midpoint of the 2-up filter) to form a single cigarette.

The present invention has been described in detail, including the preferred embodiments thereof. However, it will be appreciated that those skilled in the art, upon consideration of the present disclosure, may make modifications and/or improvements on this invention and still be within the scope and spirit of this invention as set forth in the following claims.

What is claimed is:

1. A method of continuously manufacturing cigarettes comprising steps of:

(a) continuously providing an insulated fuel element;

(b) continuously providing a substrate tube section;

(c) continuously combining said insulated fuel element and substrate tube section with an overwrap material to form a fuel-substrate section;

(d) continuously providing a roll of tobacco cut filler;

(e) continuously providing a plug of tobacco containing paper;

(f) continuously combining the tobacco roll and the tobacco containing paper plug with an overwrap to form a tobacco section;

(g) continuously aligning the fuel substrate section and the tobacco section so that the substrate tube assembly is aligned and abuts the tobacco paper plug and combining said sections with an overwrap to form a tobacco fuel unit;

(h) continuously providing a filter element; and (i) continuously combining the filter element with the tobacco fuel unit to form a filter cigarette.

2. The method of claim 1, wherein said insulated fuel element is provided by:

(a) extruding a continuous carbonaceous rod of a desired configuration into a wrapper of continuous insulating wrapper material; and (b) cutting the continuous insulated fuel rod into desired lengths.

3. The method of claim 2, further including the step of drying the insulated carbonaceous fuel elements to a desired moisture content.

4. The method of claim 3, wherein carbonaceous fuel elements are dried to a moisture content of between 12% and 14% by weight.

5. The method of claim 3, wherein said drying step is carried out in two separate stages during the cigarette manufacturing process.

6. The method of claim 2, wherein said insulated fuel rod is cut into 6-up lengths, and further including the steps of:

(a) cutting the 6-up insulated fuel rod into insulated fuel elements;

(b) separating the insulated fuel elements;

(c) inserting a 2-up substrate tube assembly between the insulated fuel elements;

(d) aligning and abutting the 2-up substrate tube assembly and the insulated fuel elements; and (e) overwrapping the 2-up substrate tube assembly and the insulated fuel elements with a wrapper to form a 2-up fuel substrate section.

7. The method of claim 6, wherein said tobacco roll is provided in a 2-up length and said tobacco paper plugs are provided in 2-up lengths, and said tobacco roll and said tobacco paper plug are:

(a) aligned in alternate abutting sequence;

(b) overwrapping the alternating abutting tobacco roll and tobacco paper plug with a wrapper material; and (c) cutting the overwrapped components into tobacco sections having a 2-up tobacco roll in the center with a tobacco paper plug on opposite ends.

8. The method of claim 7, further including the steps of:

(a) dividing the 2-up fuel substrate section at its midpoint;

(b) separating the fuel substrate sections;

(c) inserting a tobacco section between the fuel substrate sections;

(d) aligning and abutting the end of the fuel substrate section with the 2-up tobacco section; and (e) overwrapping the assembled components to form a 2-up tobacco fuel unit.

9. The method of claim 8, wherein said filter element is provided in a 2-up length, and further including the steps of:

(a) dividing the 2-up tobacco fuel unit at its midpoint;

(b) inserting the 2-up filter between the two tobacco fuel units, (c) overwrapping the assembled components with a wrapper to form a 2-up filter cigarette; and (d) cutting the 2-up filter cigarette at the midpoint of the filter to form a filter cigarette.

10. A method of manufacturing cigarettes comprising steps of:

(a) providing an insulated fuel dement;

(b) providing a substrate tube section;

(c) combining said insulated fuel element and substrate tube section with an overwrap material to form a fuel-substrate section;

(d) providing a roll of tobacco cut filler;

(e) providing a plug of tobacco containing paper;

(f) combining the tobacco roll and the tobacco containing paper plug with an overwrap to form a tobacco section;

(g) aligning the fuel substrate section and the tobacco section so that the substrate tube assembly is aligned and abuts the tobacco paper plug and combining said sections with an overwrap to form a tobacco fuel unit;

(h) providing a filter element; and combining the filter element with the tobacco fuel unit to form a filter cigarette wherein said substrate tube section is formed by the steps of:

(a') providing a rod of continuous substrate material;

(b') cutting the substrate material into desired lengths to form substrate plugs;

(c') aligning and separating the substrate plug at desired intervals;

(d') forming a continuous tube around the aligned and spaces substrate plugs;

(e') cutting the continuous tube at selected locations to form a substrate tube assembly having at least one substrate plug with voids on opposite sides of the substrate plug.

11. The method of claim 10, further including the step of applying an aerosol forming material to said substrate material while forming the continuous substrate rod.

12. The method of claim 10, further including the step of applying an aerosol forming material to the substrate plug within the substrate tube assembly.

13. A method of continuously manufacturing cigarettes comprising the steps of:

(a) continuously forming an insulated fuel rod and cutting the rod into predetermined lengths;

(b) continuously forming a substrate rod and cutting the rod into predetermined lengths;

(c) continuously combining said insulated fuel rods and said substrate rods with an overwrap material to form a fuel substrate section;

(d) continuously providing a roll of tobacco cut filler;

(e) continuously providing a filter element;

(f) aligning and combining the filter element and the roll of tobacco cut filler to form a tobacco filter section; and (g) continuously aligning the fuel substrate section and the tobacco filter section so that the substrate is aligned with and abuts the tobacco roll, and combining said sections with an overwrap to form a cigarette.

14. The method of claim 13, wherein the insulated fuel element is provided by extruding a combustible fuel material into an insulating material.

15. The method of claim 14, further including the step of drying the insulated carbonaceous fuel elements to a desired moisture content.

16. The method of claim 13, wherein the substrate section is provided by forming a cast sheet of substrate material, and forming the cast sheet into the shape of a rod.

17. The method of claim 16, wherein the substrate material is formed into a sheet, and the sheet is cut into cut filler prior to being formed into the shape of a rod.

18. The method of claim 13, wherein the insulator material is formed by sandwiching a layer of flavorant material between two insulator layers.

19. The method of claim 18, where the insulator layers comprise fiberglass.

20. The method of claim 13, further including the step of applying an aerosol forming material to said substrate material while forming the continuous substrate rod.

21. A method of manufacturing cigarettes comprising the steps of:

(a) providing an insulated fuel element;

(b) providing a substrate section;

(c) combining said insulated fuel element and substrate section with an overwrap material to form a fuel substrate section;

(d) providing a roll of tobacco cut filler;

(e) providing a filter element;

(f) combining the filter element and the roll of tobacco cut filler to form a tobacco filter section;

(g) aligning the fuel substrate section and the tobacco filter section so that the substrate is aligned with and abuts the tobacco roll, and combining said sections with an overwrap to form a cigarette;

wherein the insulated fuel elements are cut 6-up, and the substrate sections are cut 2-up, and further comprising the steps of:

(a') cutting the 6-up insulated fuel rod into insulated fuel elements;

(b') separating the insulated fuel elements;

(c') inserting a 2-up substrate section assembly between the insulated fuel elements;

(d') aligning and abutting the 2-up substrate section assembly and the insulated fuel elements; and (e') overwrapping the 2-up substrate section assembly and the insulated fuel elements with a wrapper to form a 2-up fuel substrate section.

22. The method of claim 21, wherein said tobacco cut filler roll is provided in a 2-up length and said filter element is provided in a 2-up length, and wherein said tobacco cut filler roll and said filter element are:

(a) aligned in alternate abutting sequence;

(b) overwrapping the alternating abutting tobacco cut filler roll and filter element with a wrapper material; and (c) cutting the overwrapped components into mouthend sections having a 2-up filter in the center with a tobacco cut filler roll on opposite ends.

23. The method of claim 22, further including the steps of:

(a) dividing the 2-up fuel substrate section at its midpoint;

(b) separating the fuel substrate sections;

(c) inserting a mouthend section between the fuel substrate sections;

(d) aligning and abutting the end of the fuel substrate section with the 2-up mouthend section; and (e) overwrapping the assembled components to form a 2-up filter cigarette.

24. The method of claim 23, further including the step of cutting the 2-up filter cigarette at the midpoint of the filter to form filter cigarettes.

* * * * *